United States Patent [19]

Soja et al.

[11] 4,113,100

[45] Sep. 12, 1978

[54] DISPLAY CARTON

[75] Inventors: Lawrence M. Soja; Daniel F. Stokes, both of Chicago; Richard W. Beile, Park Ridge, all of Ill.

[73] Assignee: Stone Container Corporation, Chicago, Ill.

[21] Appl. No.: 762,874

[22] Filed: Jan. 27, 1977

[51] Int. Cl.[2] ..... B65D 5/54

[52] U.S. Cl. ..... 206/602; 206/606; 206/628

[58] Field of Search ..... 229/51 DB, 51 TS, 51 S; 206/498, 602, 606, 608, 623, 627, 628

[56] References Cited

U.S. PATENT DOCUMENTS

| | | | |
|---|---|---|---|
| 2,864,548 | 12/1958 | Zastrow | 206/602 |
| 3,168,234 | 2/1965 | Bartz | 229/51 DB |
| 3,510,046 | 5/1970 | Reiner | 206/602 |
| 3,531,045 | 9/1970 | Johnson | 229/51 TS |
| 3,829,006 | 8/1974 | Spiegel | 206/628 |
| 3,884,348 | 5/1975 | Ross | 206/606 |
| 4,000,811 | 1/1977 | Hardison et al. | 229/51 TS |
| 4,008,849 | 2/1977 | Baber | 229/51 TS |

*Primary Examiner*—William Price
*Assistant Examiner*—Joseph M. Moy
*Attorney, Agent, or Firm*—Silverman, Cass & Singer, Ltd.

[57] ABSTRACT

A display carton formed from a foldable, integral paperboard blank having top, front, bottom and rear walls joined together, each of said walls including a pair of side flaps hingedly connected to opposite ends thereof to form a display carton. The front and rear walls include a tear strip extending lengthwise across the walls and extending across the respective front and rear wall side flaps to form a continuous tear strip around the display carton. The top and bottom side flaps have a length less than the height of the carton to provide a gap aligned with the tear strip on each side of the carton. The tear strip is removable to separate the top portion from the bottom portion of the carton to expose the contents of the carton and to render the bottom portion of the sealed carton useable thereafter as a display tray holding the contents of the carton.

1 Claim, 3 Drawing Figures

DISPLAY CARTON

BACKGROUND OF THE INVENTION

1. Field of the Invention

This invention relates generally to paperboard display containers, and more particularly, to a display package having a novel tear strip extending continuously around the container to allow the container to be separated into two portions to provide a tray for displaying the contents of the container.

2. Description of the Prior Art

Cartons of the type disclosed in U.S. Pat. No. 3,917,158 which are capable of being erected and discharged as sealed cartons by means of automatic carton folding machines are highly desirable in the packaging field because of the economics of this business. High volume users of such packages desire high speed carton folding machines which will enable them to package their products rapidly and efficiently with due regard that such previous cartons are regarded as disposable products. In connection with certain products, it is very desirable to have a carton or package capable of being formed in high speed carton folding machines which also may be used as attractive display cartons or packages by retail outlets after the cartons are opened. Such retail outlets are enabled to use the same cartons in which they receive the products as display packages in full view of retail customers and thereby, obviate the need and attendant cost for a separate display tray packaged with the products. To enhance the appearance and information value with respect to the products, such cartons canbe suitably imprinted:

To allow the carton discussed U.S. Pat. No. 3,917,158 to be separated to display the contents of the carton, special flap configurations are formed on the carton blank. It would be desirable to avoid the special flap tortuous configuration and attendant gluing procedures thereof, while still providing a sealed carton which may be easily separated to display the contents thereof.

SUMMARY OF THE INVENTION

A display carton formed from a one-piece, prescored blank foldable to provide top, bottom, front and rear walls connected together. Each wall includes a pair of side flaps, one hingedly connected to opposite ends thereof to form a sealed carton or container. A tear strip is provided extending continuously around the carton for separating the top portion from the bottom portion to expose the contents of the carton. The tear strip extends across the front and rear walls and their corresponding side flaps. The side flaps of the top and bottom walls are of a length less than the height of the container to form a gap between the ends thereof, which aligns with the tear strip on the sides of the carton. These last mentioned side flaps may be so designed to form the closure as either the inside or outside flaps.

DESCRIPTION OF THE PREFERRED EMBODIMENT

Figure 1:
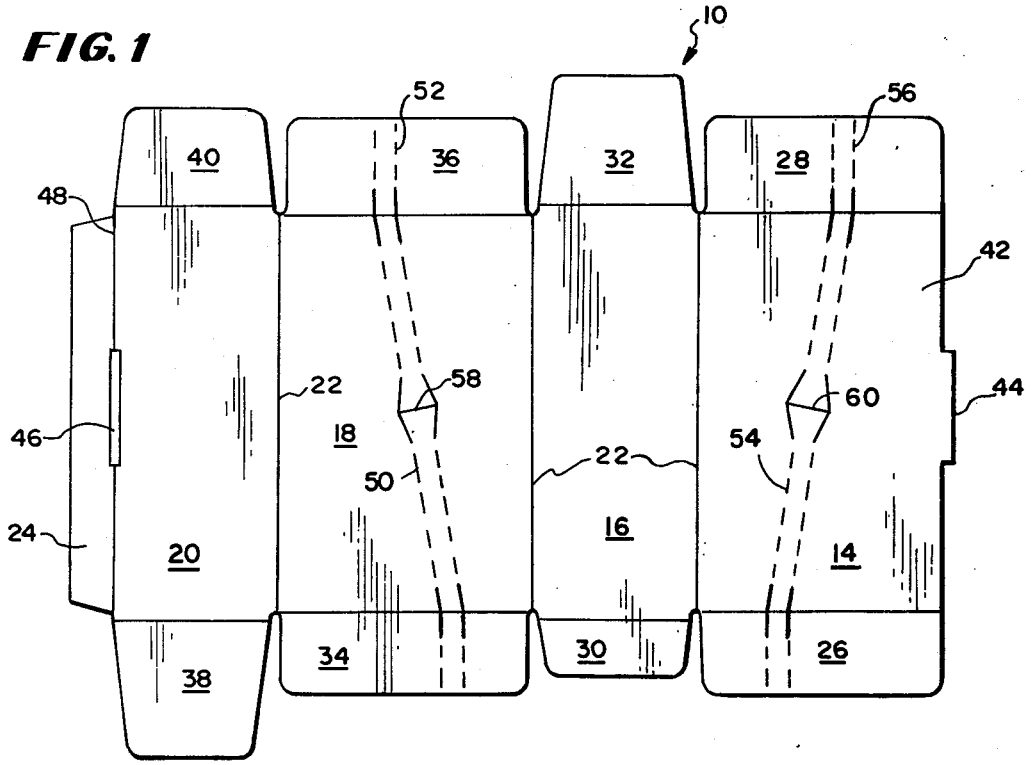
FIG. 1 is a plan view of a carton blank embodying the invention.

FIG. 1 , there is illustrated a carton blank 10 which may be die-cut from sheeting of paperboard, either corrugated or otherwise, by conventional automatic machinery. The blank 10 is prescored for folding into a sealed carton designated 12 in FIG. 2. There is provided a front wall 14, a bottom wall 16, a rear wall 18 and a top wall 20. The wall or panels are joined together by lines of fold 22 to facilitate erection of the carton 12 in a well known manner. The blank 10 includes a front flap 24, more commonly known as a manufacturer's lap or flap. The walls 14, 16, 18, and 20, respectively, are provided with pairs of side flaps 26, 28; 30, 32; 34, 36; and 38, 40, along lines of fold as illustrated.

An outer free edge 42 is provided with an extension tab or tongue 44 on the front wall 14. The tab 44 is designed to be engaged in a slot 46 provided in a line of fold 48 between the flap 24 and the top wall 20. The construction and operation of the tab 44 and the slot 46 are described and claimed in U.S. Pat. No. 3,744,705. It is to be understood, however, that the carton blank 10 can be formed without the tab 44 and the slot 46.

The rear wall 18 and is respective side flaps 34 and 36 are provided with a pair of substantially parallel perforation lines 50 and 52. The front wall and its respective side flaps 26 and 28 are provided with a corresponding pair of perforation lines 54 and 56. Each of the pairs of perforation lines is provided with tear starting tabs 58 and 60, respectively.

Figure 2:
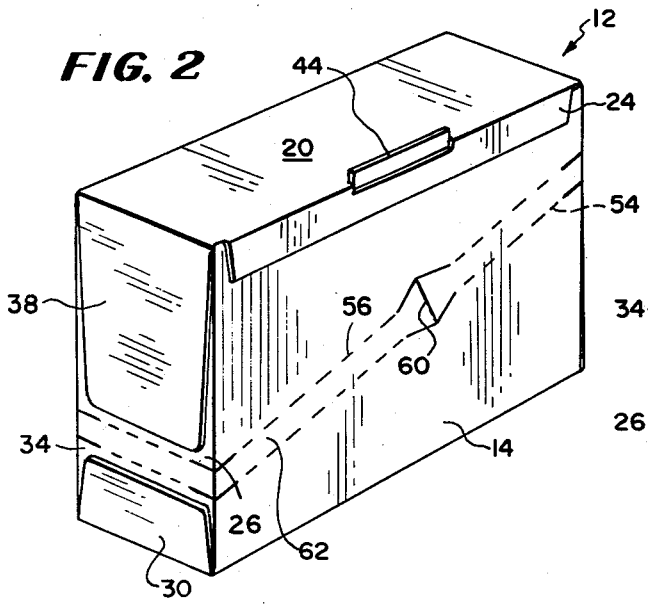
FIG. 2 is a perspective view of the blank illustrated in FIG. 1 erected into a sealed display container.

The carton blank 10 may be assembled manually or as generally will be the case, by a packaging machine. In FIG. 2, the assembled blank 10 is shown as the sealed carton 12. The blank 10 is designed and adapted most effectively for assembly about the items or lading intended to be packaged. That is, the items are positioned on one of the panels, such as the bottom wall 16 of the blank 10 and the blank thereafter is assembled around the items and sealed.

Figure 3:
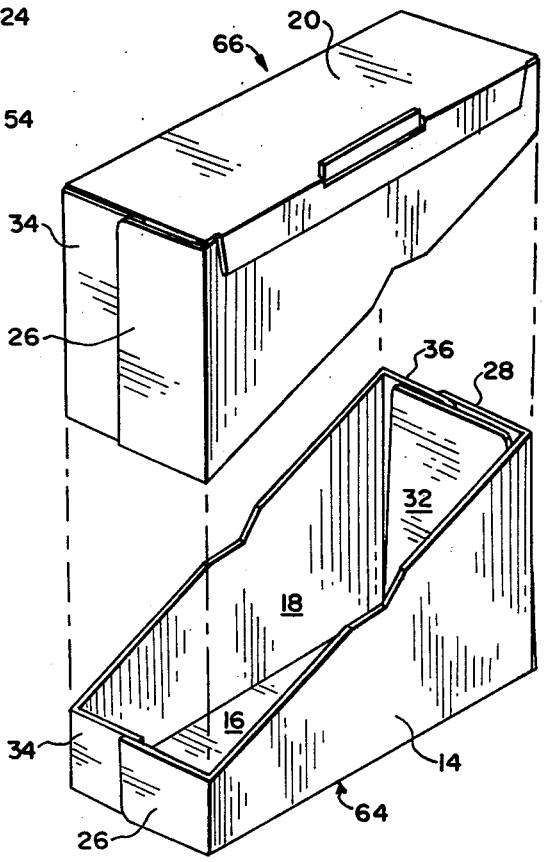
FIG. 3 is an exploded perspective view showing the tear strip of the carton removed to provide a display tray which can function as the display package, this view illustrating an alternate manner of folding the side flaps externally.

The two pairs of perforation lines are aligned such that the completed and sealed carton 12 is formed with a continuous tear strip 62 around the entire carton 12. The side flaps 30, 38 and 32, 40 are folded inside or outside the pairs of flaps 26, 28 and 34, 36. The flaps 30, 38 and 32, 40 are designed to align with the tear strip 62 and to form a gap substantially equal to the width of the tear strip on the pairs of side flaps 26, 28 and 34, 36. In this manner, the sealed carton 12 is rigidly formed; however, the removal of the tear strip 62, accomplished by grasping the tear starting tab 60 and tearing the tear strip 62 from the display carton 12, will result in two separated portions 64, 66, as illustrated in FIG. 3.

The gap between the ends of the respective side flaps 30, 38 and 32, 40 allows the two portions 64, 66 to be separated to display the lading or contents without interfering with the tear strip 62. The lading or contents of the package, although not shown, will be understood to remain on the bottom separated portion 64.

It is to be understood that the invention contemplates implementation thereof in connection with other than the diagonal tear strips 62 illustrated. The tear strip may be disposed at a greater or lesser angle around the carton, may be of a varying width, may have non-parallel perforation lines and may be placed at different elevations on the carton, as described. The respective sizes illustrated are also illustrated as an example, and many other combinations of sizes of the walls and tear strip 62 and the corresponding assembled carton 12 are possible within the scope of the invention.

What is claimed and desired to be secured by Letters Patent of the United States is:

1. A folded display carton forming blank comprising two cartons end panels and two carton face panels, said panels each having opposed side edges and opposed end edges, one of said face panels being positioned between the two end panels with the opposed side edges of the one face panel being respectively integrally hinged to one side edge of each of the two end panels, the second of said face panels being integrally hinged to the second side edge of one of said end panels, the opposed end edges of the panels being generally aligned in two parallel rows along opposed longitudinal edges of the blank, each of said panels having a side flap integrally hinged to each of the opposed end edges thereof, the improvement comprising:

a. a tear strip formed diagonally across each of said face panels between the opposed longitudinal edges of the blank, each tear strips, at the opposed ends thereof, including continuations extending across the associated side flaps generally perpendicular to the longitudinal edges of the blank, said tear strips being mirror images of each other;

b. the side flap of a first end panel being longer than the side flap of the second end panel along a first longitudinal edge of the blank, the side flap of the second end panel being longer than the side flap of the first end panel along the second longitudinal edge of the blank;

c. the combined lengths of the end panel side flaps on each longitudinal edge of the blank, perpendicular to the longitudinal edge, being less than the face panel width between the opposed side edges thereof to define a gap between the side flaps on each longitudinal edge of the blank in the folded carton alignable with the tear strip continuations in the side flaps of the face panels on the same longitudinal edge of the blank.

* * * * *